United States Patent [19]
Frazel
[11] 4,204,809
[45] May 27, 1980

[54] WIDE RANGE CONTROL FOR DELIVERY APPARATUS

[75] Inventor: Wilbur H. Frazel, Riverside, R.I.
[73] Assignee: General Signal Corporation, Stamford, Conn.

[21] Appl. No.: 860,358
[22] Filed: Dec. 14, 1977
[51] Int. Cl.² ..... F04B 49/06; F04B 49/00
[52] U.S. Cl. ..... 417/15; 417/53
[58] Field of Search ..... 417/15, 53, 42; 60/448, 60/DIG. 2, 431, 423; 137/3; 235/92 FL

[56] References Cited

U.S. PATENT DOCUMENTS

| | | | |
|---|---|---|---|
| 2,774,436 | 12/1956 | Ferris | 60/423 |
| 3,003,309 | 10/1961 | Bowers et al. | 417/316 |
| 3,600,563 | 8/1971 | Porter | 235/92 FL |
| 3,605,775 | 11/1971 | Zaander et al. | 137/3 |
| 3,927,528 | 12/1975 | van der Kolk | 60/431 |
| 3,937,597 | 2/1976 | Bacquie et al. | 417/15 |
| 4,026,321 | 5/1977 | Kahoe | 137/487.5 |
| 4,074,955 | 2/1978 | Nonnemacher et al. | 60/448 |

FOREIGN PATENT DOCUMENTS

| | | | |
|---|---|---|---|
| 2455598 | 5/1976 | Fed. Rep. of Germany | 417/42 |

*Primary Examiner*—William L. Freeh
*Attorney, Agent, or Firm*—Jeffrey S. Mednick

[57] ABSTRACT

An apparatus is provided for delivering a substance to a desired point and includes a delivery means responsive to n independent controls for delivering the substance to the desired point at a particular delivery rate, with n being equal to an integer greater than 1. An input signal is provided indicative of the desired delivery rate and means are provided for taking the n th root of the input signal and simultaneously communicating the resultant signal to each of the independent controls, whereby wide range control of the delivery means is effected.

16 Claims, 1 Drawing Figure

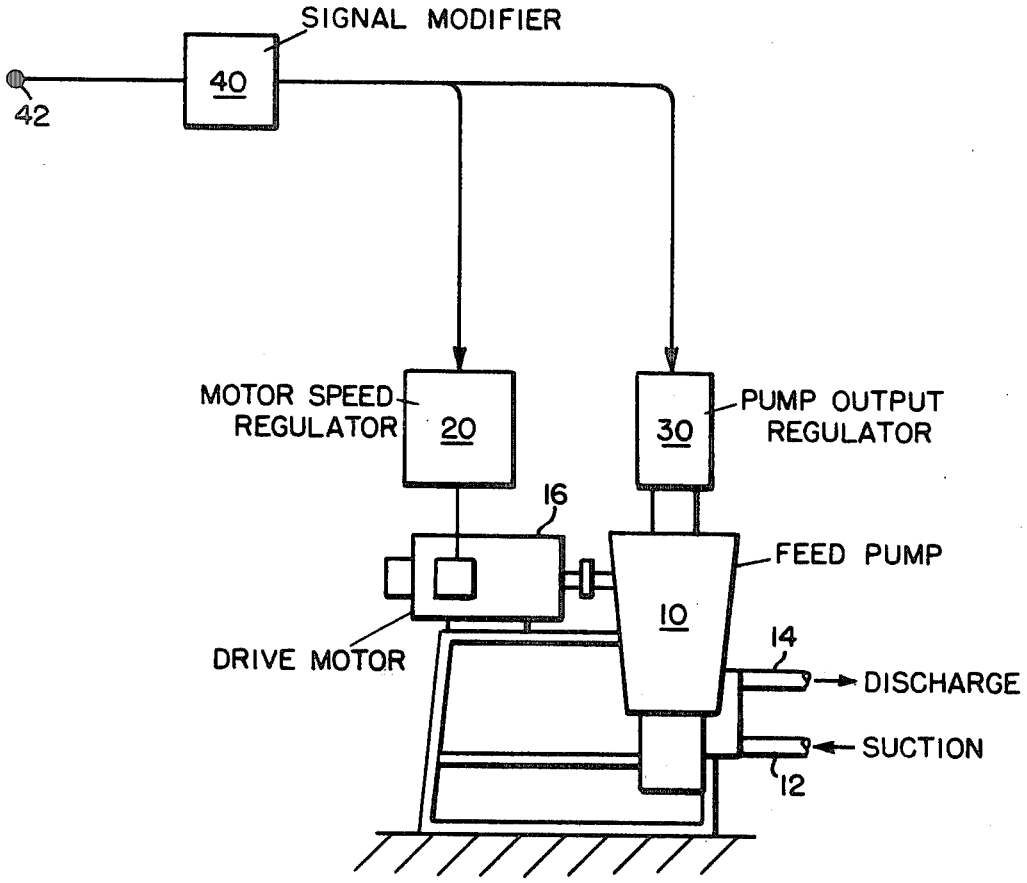
SIGNAL MODIFIER
40
42
MOTOR SPEED REGULATOR
20
30
PUMP OUTPUT REGULATOR
16
FEED PUMP
10
14
DRIVE MOTOR
DISCHARGE
SUCTION
12

WIDE RANGE CONTROL FOR DELIVERY APPARATUS

BACKGROUND OF THE INVENTION

The present invention relates generally to an apparatus for effecting wide range control of a delivery means responsive to at least two independent controls and more particularly to an apparatus for effecting wide range control of a pump.

In many instances, it is necessary to deliver a substance to a desired point at a delivery rate that is responsive to at least two independent parameters. For example, a chemical feed pump may have both a stroke adjustment and a speed adjustment. In certain of these instances, the required delivery rate is proportional to the value of a single signal having a wide operating range, for example, from 100% pump output down to 1% of maximum pump output. Typically, neither the stroke adjustment nor the speed adjustment are capable of accurately controlling the pump over such a wide range. For example, these adjustments may be reasonably accurate over only a control range of 10 to 1. Operating under these constraints, it has been necessary to devise techniques to permit wide range control of such delivery apparatuses suitable for response to a single control signal.

To date, one way this problem has been overcome is by applying the control signal to the first control to effect a first range of reduction in capacity, while holding the second control at its maximum position. After the first control reaches a predetermined level, the control signal is then switched to the second control, multiplied by a compensating factor, and then utilized to reduce the second control to a predetermined level. Thus, in the above example the pump stroke could be reduced from a 100% down to 10% while maintaining pump speed at 100%. The pump stroke could then be maintained at 10% while a multiplying signal of 10 was applied to the control signal permitting reduction of pump speed from 100% down to 10%.

Such a control scheme is also illustrated in U.S. Pat. No. 3,493,167 to Akerhielm, et al. This patent shows a control system for regulating the capacity of centrifugal compressor by varying the compressor speed to effect a first range of reduction in capacity and thereafter maintaining compressor speed constant while varying a compressor guide vane adjustment to effect an additional capacity reduction.

Although such prior systems have proved effective in obtaining wide range delivery from a single control signal, their degree of accuracy has not always been satisfactory. Applicant has discovered that by devising a scheme whereby both controls may be modified simultaneously, accuracy may be significantly improved.

SUMMARY OF THE INVENTION

Accordingly, an apparatus has been provided for delivering a substance to a desired point and includes a delivery means responsive to n independent controls for delivering the substance to the desired point at a particular delivery rate, with n being equal to an integer greater than 1. An input signal is provided indicative of the desired delivery rate and means are provided for taking the nth root of the input signal and simultaneously communicating the resultant signal to each of the independent controls, whereby wide range control of the delivery means is effected.

OBJECTS OF THE INVENTION

An object of the present invention is the provision of an apparatus for delivering a substance to a desired point over a wide range of accurate delivery rates.

Another object of the present invention is the provision of an apparatus for delivering a substance to a desired point which is capable of utilizing a single control signal to simultaneously modify at least two independent controls.

A further object of the present invention is the provision of an apparatus for accurately controlling the output of a pump over a wide range of pump output.

Still another object of the present invention is an apparatus for controlling the output of a pump by simultaneously controlling the pump stroke length and the pump speed in response to a single control signal.

A still further object of the present invention is the provision of a wide range control for a delivery apparatus which utilizes known control devices to enable the apparatus to be simply and inexpensively manufactured.

Other objects, advantages, and novel features of the present invention will become apparent from the following detailed description of the invention when considered in conjunction with the accompanying drawings.

BRIEF DESCRIPTION OF THE DRAWINGS

The FIGURE shows a schematic representation of the wide range delivery apparatus of the present invention.

DESCRIPTION OF THE PREFERRED EMBODIMENT

The FIGURE shows, in schematic form, a typical application for the wide range control scheme of the present invention. A feed pump 10 having a suction port 12 and a discharge port 14 is suitably mounted for delivering fluid from a supply to a desired delivery point. The feed pump 10 may be any pump responsive to at least two independent controls for determining the delivery rate at which the substance to be pumped is delivered to the desired point. For example, the feed pump 10 may be selected from the Series 1700 Metering Pumps manufactured by BIF, a unit of General Signal Corporation. Such a pump is substantially illustrated in U.S. Pat. No. 3,312,171 to Francis H. Cary.

The pump 10 may be driven by any suitable drive means, such as, electric motor 16. The speed of drive motor 16 is controlled by a motor speed regulator 20. The motor speed regulator 20 may be any known motor speed control, such as, SCR Motor Speed Controls, Series 8500, 8600, and 8800, manufactured by the Seco Electronics Corporation. The motor speed regulator 20 functions to cause drive motor 16 to operate at an output speed which is responsive to an input signal.

A pump output regulator 30 is provided for controlling the pump output for each cycle of pump 10 in response to a given input signal. The pump output regulator in the preferred embodiment is a stroke length regulator and may be selected from a number of known devices such as, capacity control models MEP, AEP and AEI manufactured by BIF, a unit of General Signal Corporation.

A signal modifier 40 is connected to both a motor speed regulator 20 and the pump output regulator 30.

The signal modifier 40 is adapted to receive an input signal at terminal 42, modify the signal, and simultaneously communicate the resultant signal to the motor speed regulator 20 and the stroke length regulator 30. In this preferred embodiment the signal modifier 40 is a circuit which takes the square root of the input signal 42. Any number of known square root extractor circuits can be utilized to perform this function, such as, model number 1336N manufactured by Taylor Instrument Company, a unit of Sybron Corporation.

The output of pump 10 is governed by the following relationship:

$P = p \times r$ where,

P = pump output in volume per unit time

P = volume per stroke of pump output per pump cycle r = number of pump cycles per unit time.

Thus, if the input signal applied at terminal 42, indicative of the desired delivery rate, were applied directly to motor speed regulator 20 and stroke length regulator 30, the following results would be obtained:

TABLE I

| Required Delivery as % of P max. | Signal | Stroke Length as % of P max. | Speed as % of r max. | Actual Delivery as % of P max. | |
|---|---|---|---|---|---|
| 100 | 100 | 100 | 100 | 100.00 | correct |
| 75 | 75 | 75 | 75 | 56.25 | incorrect |
| 50 | 50 | 50 | 50 | 25.00 | incorrect |
| 25 | 25 | 25 | 25 | 6.25 | incorrect |
| 10 | 10 | 10 | 10 | 1.00 | incorrect |
| 1 | 1 | 1 | 1 | .01 | incorrect |

On the other hand, by taking the square root of the input signal applied at terminal 42 and then delivering the resultant signal simultaneously to motor speed regulator 20 and stroke length regulator 30, the following results are obtained:

TABLE II

| Required Delivery as % of P max. | Signal | Stroke Length as % of P max. | Speed as % of r max. | Actual Delivery as % of P max. | |
|---|---|---|---|---|---|
| 100 | 100.0 | 100.0 | 100.0 | 100 | correct |
| 75 | 86.6 | 86.6 | 86.6 | 75 | correct |
| 50 | 70.7 | 70.7 | 70.7 | 50 | correct |
| 25 | 50.0 | 50.0 | 50.0 | 25 | correct |
| 10 | 31.6 | 31.6 | 31.6 | 10 | correct |
| 1 | 10.0 | 10.0 | 10.0 | 1 | correct |

Thus, it can be seen that by utilizing the signal modifier 40 correct results are obtained over the entire operating range of the delivery apparatus from 100% down to 1% of maximum delivery rate. In addition, except for very low delivery rates, both the stroke length and the speed are maintained significantly above the lower limits of accuracy for the delivery apparatus.

Although the preferred embodiment suggests the use of electronic controls to be utilized as the motor speed regulator 120, the stroke length regulator 30 and the signal modifier 40, it should be understood that suitable pneumatic controls are also available in the prior art for performing the function required by the present invention. Additionally, computers may be programmed to output square root signals of the type required by the signal modifier 40.

Although the preferred embodiment of the present invention is concerned with a delivery apparatus which is responsive to two independent controls, it should be understood that the principles embodied in the present invention are equally applicable to a delivery means responsive to n independent controls where n is an integer greater than 1. Thus, in the general case, the signal modifier 40 would provide means for taking the nth root of the input signal 42 and communicating the resultant signal to each of the independent controls, whereby wide range control of the delivery means would be effected. Stated another way, the signal modifier 40 provides a control signal which is exponentially proportional to the input signal; the exponent being 1/n where n is an integer greater than 1.

Thus, an apparatus has been provided for delivering a substance to a desired point over a wide range of accurate delivery rates. This apparatus is capable of utilizing a single control signal to simultaneously modify at least two independent controls. As a preferred embodiment of this apparatus, the output of a pump is controlled over a wide output range by simultaneously controlling the pump stroke length and the pump speed in response to a single control signal. The apparatus utilizes known control devices and thus may be simply and inexpensively manufactured.

While there has been described what is at present considered to be the preferred embodiment of the present invention, it will be obvious to those skilled in the art that various changes and modifications may be made therein, without departing from the invention, and it is, therefore, aimed in the appendant claims to cover all such changes and modifications as followed in the true spirit and scope of the invention.

What we claim is:

1. An apparatus for delivering a substance to a desired point at a desired delivery rate comprising:

(a) delivery means, including a drive motor and a motor driven variable displacement pump, having at least two independent controls including a motor speed control and a pump displacement control, and operable for delivering the substance to the desired point at a delivery rate proportional to the product of the independent controls;

(b) regulating means operatively associated with said independent controls and responsive to a control signal for regulating each independent control in proportion to said control signal;

(c) means for providing an input signal indicative of the desired delivery rate; and (d) means for modifying said input signal to derive a single, exponential control signal and simultaneously communicating said exponential control signal to said regulating means whereby said delivery means is operated at the desired delivery rate that is linearly proportional to said input signal and a wide range control of said delivery means is affected.

2. An apparatus as set forth in claim 1 wherein said regulating means comprises means associated with said pump for varying the displacement control of said pump.

3. An apparatus as set forth in claim 1 wherein said regulating means includes means for regulating the speed control of said drive motor.

4. An apparatus as set forth in claim 1 wherein said regulating means includes means for reducing the displacement of said pump to 10 percent of the maximum pump displacement and the speed of said drive motor to 10 percent of the maximum speed, whereby overall output of said pump may be reduced to one percent of maximum pump output.

5. An apparatus as set forth in claim 1 wherein said regulating means includes means for reducing the output of said delivery means to 10 percent of the maximum output for said delivery means, whereby overall output of said delivery means may be reduced to one percent of maximum output.

6. An apparatus as set forth in claim 1 wherein said means for modifying said input signal comprises means for taking the square root of said input signal.

7. An apparatus for delivering a substance to a desired point at a desired delivery rate comprising:

(a) delivery means, including a drive motor and a motor driven pump, having n independent controls, including a motor speed control and a pump displacement control, and operable for delivering said substance to said desired point at a delivery rate proportional to the product of the n independent controls, n being equal to an integer greater than 1;

(b) regulating means responsive to a single control signal for regulating each independent control in proportion to said single control signal;

(c) means for providing an input signal indicative of the desired delivery rate; and (d) means for taking the nth root of said input signal in order to derive a single control signal and communicating said control signal to said regulating means, whereby said delivery means is operated at said desired rate that is linearly proportional to said input signal and a wide range of control of said delivery means is effected.

8. An apparatus as set forth in claim 7 wherein said regulating means comprises means associated with said pump for varying the displacement of said pump.

9. An apparatus as set forth in claim 7 wherein n is equal to 2.

10. An apparatus as set forth in claim 7 wherein said regulating means includes means for regulating the speed of said drive motor.

11. An apparatus as set forth in claim 10 wherein n is equal to 2.

12. An apparatus as set forth in claim 11 wherein said regulating means includes means for reducing the displacement of said pump to 10 percent of the maximum pump displacement and means for reducing the speed of said drive motor to 10 percent of the maximum speed, whereby overall output of said pump may be reduced to one percent of maximum pump output.

13. An apparatus for delivering a substance to a desired point at a desired delivery rate comprising:

(a) a variable stroke and a variable speed pump operable for delivering the substance to the desired point at a delivery rate proportional to the product of the pump speed and pump displacement;

(b) a drive motor connected to the pump for controlling the speed of the pump in proportion to a control signal;

(c) a drive motor speed regulator responsive to said control signal for regulating the speed of the drive motor in proportion to said control signal;

(d) a pump stroke regulator responsive to said control signal for controlling the length of stroke fo the pump in proportion to said control signal;

(e) means for providing an input signal indicative of the desired delivery rate;

(f) an input signal modifier connected to the drive motor speed regulator and to the pump stroke regulator for receiving the input signal and generating said control signal proportional to the square root of said input signal whereby the pump is operated at the desired delivery rate which is linearly proportional to said input signal.

14. A method for delivering a substance to a desired point at a desired delivery rate comprising the steps of:

delivering a substance to a desired point at a delivery rate with a variable speed and variable displacement pump having an output proportional to the product of a plurality of independent controls, including the pump speed and pump displacement;

providing an input signal indicative of the desired delivery rate;

modifying said input signal to derive an exponential control signal, and simultaneously regulating each independent control signal in proportion to said exponential control whereby the substance is delivered to the desired point at said desired delivery rate that is linearly proportional to said input signal and a wide range of delivery rates is effected.

15. A method as in claim 14 wherein there are n independent controls, including pump speed and pump displacement, n being equal to an integer greater than 1 and the step of modifying said input signal includes taking the nth root of said input signal.

16. A method as in claim 14 wherein the step of modifying said input signal includes deriving a control signal proportional to the square root of the input signal, and the step of simultaneously regulating each independent control includes regualting the stroke control and the speed control in proportion to the control signal.

* * * * *